US011267259B2

(12) United States Patent
Encrenaz et al.

(10) Patent No.: US 11,267,259 B2
(45) Date of Patent: Mar. 8, 2022

(54) DETERMINING A PARAMETER FOR CURING IMAGES

(71) Applicant: Hewlett-Packard Development Company, L.P., Spring, TX (US)

(72) Inventors: Michel Georges Encrenaz, Sant Cugat del Valles (ES); Pablo Vidal Alvarez, Sant Cugat del Valles (ES); Joaquim Bea Bonet, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/261,041

(22) PCT Filed: Jan. 9, 2019

(86) PCT No.: PCT/US2019/012919
§ 371 (c)(1),
(2) Date: Jan. 18, 2021

(87) PCT Pub. No.: WO2020/145968
PCT Pub. Date: Jul. 16, 2020

(65) Prior Publication Data
US 2021/0331490 A1 Oct. 28, 2021

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/00; B41F 23/04; B41L 23/20; F26B 3/00
See application file for complete search history.

(56) References Cited

U.S. PATENT DOCUMENTS

| | | | | |
|---|---|---|---|---|
| 5,053,826 | A | 10/1991 | Castelli et al. | |
| 6,227,643 | B1 | 5/2001 | Purcell et al. | |
| 6,354,015 | B1 | 3/2002 | Ogasawara et al. | |
| 8,055,144 | B2 | 11/2011 | Park | |
| 9,340,042 | B1 * | 5/2016 | Zengo | B41J 11/00212 |
| 2006/0239747 | A1 | 10/2006 | Han | |
| 2016/0339641 | A1 | 11/2016 | Ho et al. | |

FOREIGN PATENT DOCUMENTS

| | | |
|---|---|---|
| JP | 2010262035 | 11/2010 |
| JP | 2012155126 | 8/2012 |
| JP | 2016124268 | 7/2016 |
| KR | 2010105017 | 9/2010 |

* cited by examiner

*Primary Examiner* — Bradley W Thies
(74) *Attorney, Agent, or Firm* — HP Inc. Patent Department

(57) ABSTRACT

In an example, a method of curing images on a substrate comprises identifying the substrate, determining a deformation temperature of the substrate based on the identifying, calculating a parameter for curing images on the substrate based on the deformation temperature and a thickness of the substrate using a fuzzy logic algorithm, and causing a printing apparatus to cure the images on the substrate based on the parameter.

15 Claims, 9 Drawing Sheets

100

300

| Deformation Temperature | Thickness | Substrate Temperature Constraint |
|---|---|---|
| VL | L | VL |
| VL | M | VL |
| VL | H | L |
| L | L | L |
| L | M | L |
| L | H | M |
| M | L | M |
| M | M | M |
| M | H | H |
| H | L | M |
| H | M | H |
| H | H | VH |
| VH | L | H |
| VH | M | H |
| VH | H | VH |

400

| Substrate Temperature Constraint | Ambient Temperature | Curing Capability |
|---|---|---|
| VL | VL | VL |
| VL | L | VL |
| VL | M | VL |
| VL | H | L |
| VL | VH | L |
| L | VL | VL (*) |
| L | L | L (*) |
| L | M | L (*) |
| L | H | M (*) |
| L | VH | M |
| M | VL | L (*) |
| M | L | M (*) |
| M | M | M (*) |
| M | H | H (*) |
| M | VH | H |
| H | VL | M |
| H | L | H |
| H | M | H |
| H | H | VH |
| H | VH | VH |
| VH | VL | H |
| VH | L | VH |
| VH | M | VH |
| VH | H | VH |
| VH | VH | VH |

702

704

700

FIG. 7

| Curing Capability | Print Agent Density | Absorbency | No of Passes |
|---|---|---|---|
| VL | VL | L | L |
| VL | L | L | VL |
| VL | M | L | VVL |
| VL | H | L | No solution |
| VL | VH | L | No solution |
| VL | VL | M | M |
| VL | L | M | L |
| VL | M | M | VL |
| VL | H | M | VVL |
| VL | VH | M | No solution |
| VL | VL | H | No solution |
| VL | L | H | M |
| VL | M | H | L (*) |
| VL | H | H | VL |
| VL | VH | H | VVL |
| L | VL | L | M |
| L | L | L | L |
| L | M | L | VL |
| L | H | L | VVL |
| L | VH | L | No solution |
| L | VL | M | M |
| L | L | M | M |
| L | M | M | L |
| L | H | M | VL |
| L | VH | M | VVL |
| L | VL | H | H |
| L | L | H | M |
| L | M | H | M (*) |
| L | H | H | L |
| L | VH | H | VL |

| Curing Capability | Print Agent Density | Absorbency | No of Passes |
|---|---|---|---|
| M | VL | L | M |
| M | L | L | M |
| M | M | L | L |
| M | H | L | VL |
| M | VH | L | VVL |
| M | VL | M | H |
| M | L | M | M |
| M | M | M | M |
| M | H | M | L |
| M | VH | M | VL |
| M | VL | H | VH |
| M | L | H | H |
| M | M | H | M (*) |
| M | H | H | M |
| M | VH | H | L |
| H | VL | L | H |
| H | L | L | M |
| H | M | L | M |
| H | H | L | L |
| H | VH | L | VL |
| H | VL | M | VH |
| H | L | M | H |
| H | M | M | M |
| H | H | M | M |
| H | VH | M | L |
| H | VL | H | VH |
| H | L | H | VH |
| H | M | H | H (*) |
| H | H | H | M |
| H | VH | H | M |

1100

FIG. 11

DETERMINING A PARAMETER FOR CURING IMAGES

BACKGROUND

A printing device may apply print agent to a substrate. The print agent may subsequently be dried and cured, for example through the application of heat to the substrate. For certain substrates, such as latex substrates or other heat deformable substrates for example, application of excessive heat may cause the substrate to permanently deform.

BRIEF DESCRIPTION OF DRAWINGS

Non-limiting examples will now be described with reference to the accompanying drawings, in which:

FIG. 7 shows an example of a table of activated curing capability functions based on activated substrate temperature constraint and ambient temperature functions;

FIG. 11 shows an example of a table of activated print mode functions based on activated curing capability, print agent density and absorbency functions;

DETAILED DESCRIPTION

Figure 1:
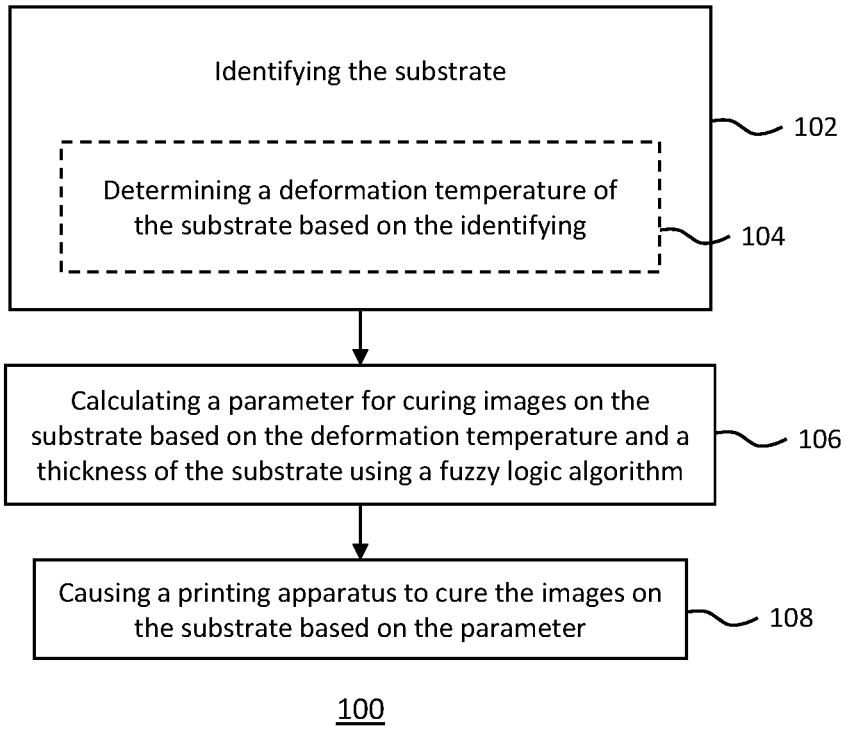
FIG. 1 is a flow chart of an example of a method of curing images on a substrate.

FIG. 1 is a flow chart of an example of a method 100, such as for example a method of curing images on a substrate. The images on the substrate may for example be applied by a printing apparatus or printing device, and/or may be applied using print agent. The method 100 comprises, in block 102, identifying the substrate. This may in some examples comprise identifying properties of the substrate such as for example a deformation temperature of the substrate and/or a thickness of the substrate. In some examples, the substrate may be identified through detection of markings on the substrate, or a user of a printing apparatus or device may provide an identification of the substrate. One or more properties (e.g. the deformation temperature) may be obtained using the identification, for example from a local or remote database. In some examples, the deformation temperature may be the lowest temperature at which the substrate becomes deformed or is likely to become deformed. In some examples, the substrate thickness may be provided by a user, or may be measured, for example by one or more sensors or devices in the printing apparatus or printing device.

Optional block 104 of the method 100 comprises determining a deformation temperature of the substrate based on the identifying. As suggested above, this may comprise retrieving the deformation temperature from a database, or may comprise receiving the deformation by other processes such as for example being provided by a user.

Block 106 of the method 100 comprises calculating a parameter for curing images on the substrate based on the deformation temperature and a thickness of the substrate using a fuzzy logic algorithm. The parameter may in some examples control a printing process such as for example the number of passes of the substrate through a printing apparatus, the speed of the substrate through the printing apparatus, and/or an amount of heat applied to the substrate. The parameter may in some examples be varied to control any of the above properties of the printing process, and/or any other property, in order to control the amount of heat applied to the substrate. In some examples, the amount of heat is controlled to avoid any portion of the substrate from reaching or exceeding the deformation temperature. In some examples, the parameter may also be controlled to increase the speed of the printing process (e.g. reduce the time to provide printed and cured images on the substrate). The fuzzy logic algorithm may in some examples calculate the parameter based on one or more other properties of the substrate, the printing process and/or other properties.

Block 108 of the method 100 comprises causing a printing apparatus to cure the images on the substrate based on the parameter. For example, the amount of heat applied to the substrate may be controlled by the parameter as suggested above. Additionally, in some examples, a property of the printing process such as the speed of the printing process may also be controlled.

Figure 2:
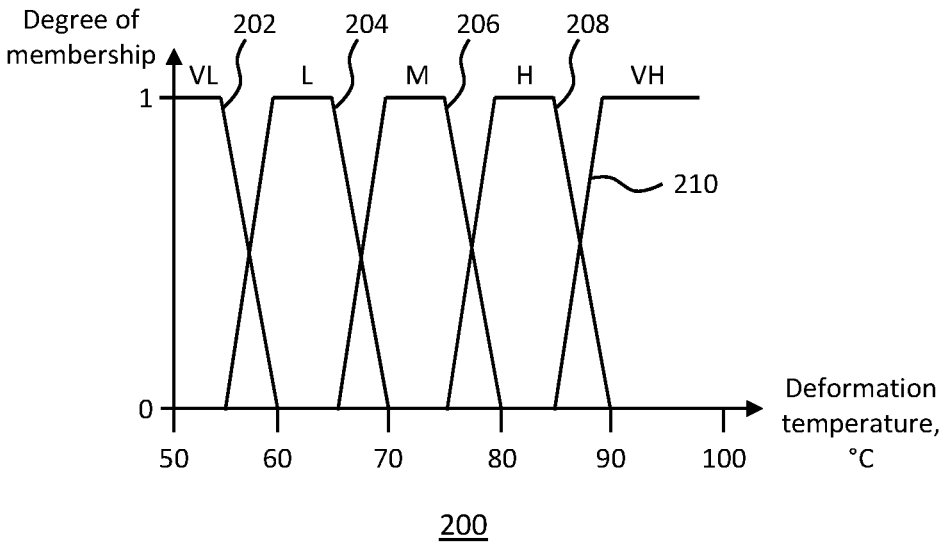
FIG. 2 is a graph showing examples of a first set of functions associated with a deformation temperature.

An example of a fuzzy logic algorithm to determine a parameter for curing images on the substrate based on the deformation temperature and a thickness of the substrate will now be described. FIG. 2 is a graph 200 showing examples of a first set of functions (also referred to in some examples as membership functions) associated with the deformation temperature. The graph 200 shows deformation temperature on the X-axis and degree of membership of the functions on the Y-axis. A first function 202, referred to as a very low (VL) deformation temperature function, can in some examples be described as having a range of up to around 60° C. The function provides the value of 1 for deformation temperatures up to around 55° C., and then slopes down to 0 at around 60° C. Thus the function 202 returns a value of 0-1, with a value greater than 0 at deformation temperatures below around 60° C. A second function 204 (e.g. a low or L deformation temperature function) has a range of around 55-70° C., that is, for example, it returns a value of greater than 0 and up to 1 for deformation temperatures of around 55-70° C. Similarly, a third function 206 (e.g. a medium or M deformation temperature function) has a range of around 65-80° C.; a fourth function 208 (e.g. a high or H deformation temperature function) has a range of around 75-90° C.; and a fifth function 210 (e.g. a very high or VH deformation temperature function) has a range of above around 80° C. Each of the functions 202-210 has sloping sides such that the closer to the centre of the range, the closer the output of the function is to 1, or the more likely the output of the function is 1. The functions, ranges and output values shown herein are merely examples, and other sets of functions associated with any parameter or property may include any number of functions with any suitable ranges, shapes and/or output values.

In an example, a deformation temperature of a substrate on which images are printed or to be printed is 60° C. This lies within the range of the low (L) function 204, thus in some examples the function 204 is "activated," and provides a value of 1 for that function 204. In addition, the deformation temperature of 60° C. lies within the range of the very low (VL) function 202, and thus in some examples the function 202 is also "activated," though the output of the function 202 at a deformation temperature of 60° C. is 0.

Figures 3, 4:
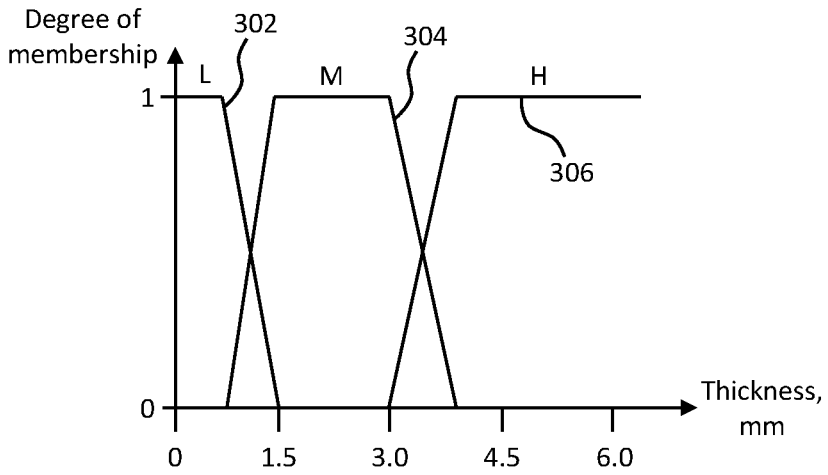
FIG. 3 is a graph showing examples of a second set of functions associated with a substrate thickness.
FIG. 4 shows an example of a table of activated substrate temperature constraint functions based on activated deformation temperature and thickness functions.

FIG. 3 is a graph 300 showing examples of a second set of functions (also referred to in some examples as membership functions) associated with the substrate thickness. The graph 300 shows deformation temperature on the X-axis and degree of membership of the functions on the Y-axis. A first function 202, referred to as a low (L) thickness function, has a range of up to around 1.5 mm. A second function 204, referred to as a medium (M) thickness function, has a range of around 0.75-3.8 mm. A third function, referred to as a high (H) thickness function, as a range of above around 3.0 mm. In an example, a substrate has a thickness of 5.0 mm, and thus the third (high or H) function 306 is activated and returns a value of 1.

In some examples, the values obtained from the activated functions associated with the deformation temperature and thickness can be used to determine a media or substrate temperature constraint, e.g. the highest temperature that the media or substrate can reach before it deforms. In some examples, a higher temperature can be applied to thicker substrates, and thus the constraint is based on the thickness as well as the deformation temperature (which may in some examples be the deformation temperature of a predetermined thickness of the same material). In some examples, a set of functions are associated with the substrate temperature constraint. In some examples, the activated function or functions of this set of functions are based on the particular functions of the deformation temperature and thickness that are activated. An example of which function or functions are activated is shown in FIG. 4, which shows a table 400 of activated substrate temperature constraint functions based on activated deformation temperature and thickness functions. For example, given the example deformation temperature of 60° C. and thickness of 5 mm above, and the activated VL and L deformation temperature functions 202 and 204 and H thickness function 306, it can be seen from lines 3 and 6 of the table 400 that L and M substrate temperature constraint functions are activated.

Figure 5:
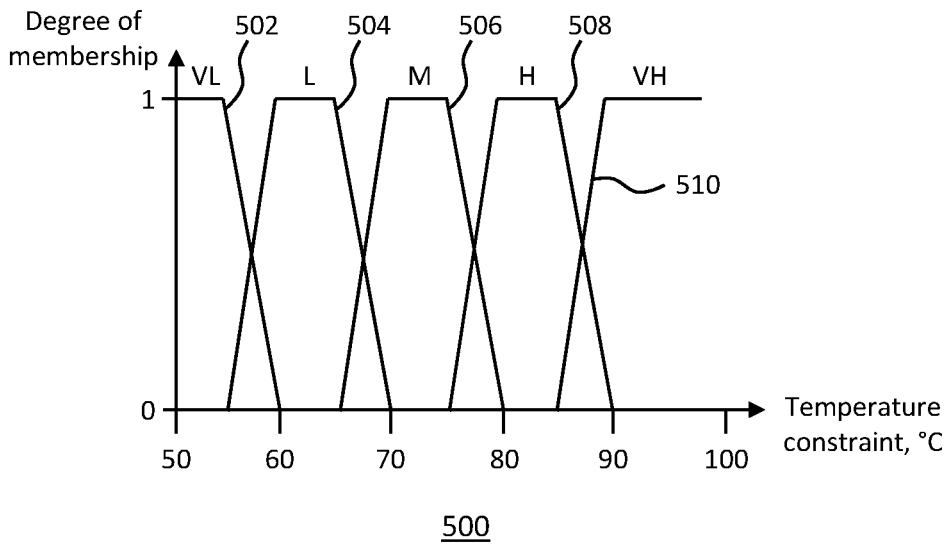
FIG. 5 is a graph showing examples of a set of functions associated with a substrate temperature constraint.

FIG. 5 shows an example of a graph 500 showing examples of a set of functions (e.g. membership functions) associated with the substrate temperature constraint. The graph 500 shows deformation temperature on the X-axis and degree of membership of the functions on the Y-axis. The set of functions includes a very low (VL) substrate temperature constraint 502, low (L) substrate temperature constraint 504, medium (M) substrate temperature constraint 506, high (H) substrate temperature constraint 508 and very high (VH) substrate temperature constraint 510. The values of the activated functions associated with the deformation temperature and thickness can be used to provide values from the activated functions of substrate temperature constraint. For example, for each activated substrate temperature constraint function, a t-norm min process can be used with values of associated functions according to table 400 in FIG. 4 to provide a substrate temperature constraint value. For example, each activated function can be clipped by the values of the antecedent functions (in the case of the substrate temperature constraint, these are the activated deformation temperature and thickness functions) identified in the table 400 shown in FIG. 4. For example, if the VL deformation temperature and H thickness functions are activated, these activate the L substrate temperature constraint function, and the values of the antecedent functions clip the area of the activated substrate temperature function. In some examples, the resulting peak value of the area can be used later in the fuzzy logic process, for example for an activated function to which the substrate temperature function is an antecedent function.

In the particular example described herein, with a deformation temperature of 60° C. and thickness of 5 mm, the activated VL deformation temperature function with a value of 0 and activated H thickness function, according to table 400 in FIG. 4, activates the L substrate temperature constraint function and provides a value of 0 (e.g. due to the VL deformation temperature function value of 0). For example, the L substrate temperature constraint function is clipped by its two antecedent function values—the value of 0 of the activated VL deformation temperature function and the value of 1 of the activated H thickness function. In this example, the lower value of 0 fully clips the L substrate temperature constraint function and the resulting peak value of the L substrate temperature constraint function is 0. In addition, the activated L deformation temperature function with a value of 1 and activated H thickness function, according to table 400 in FIG. 4, activates the M substrate temperature constraint function and provides a value of 0 (e.g. due to the L deformation temperature and H thickness function values of 1). The M substrate temperature constraint function value can be determined in some examples in a similar manner as for the L substrate temperature constraint function.

Figure 6:
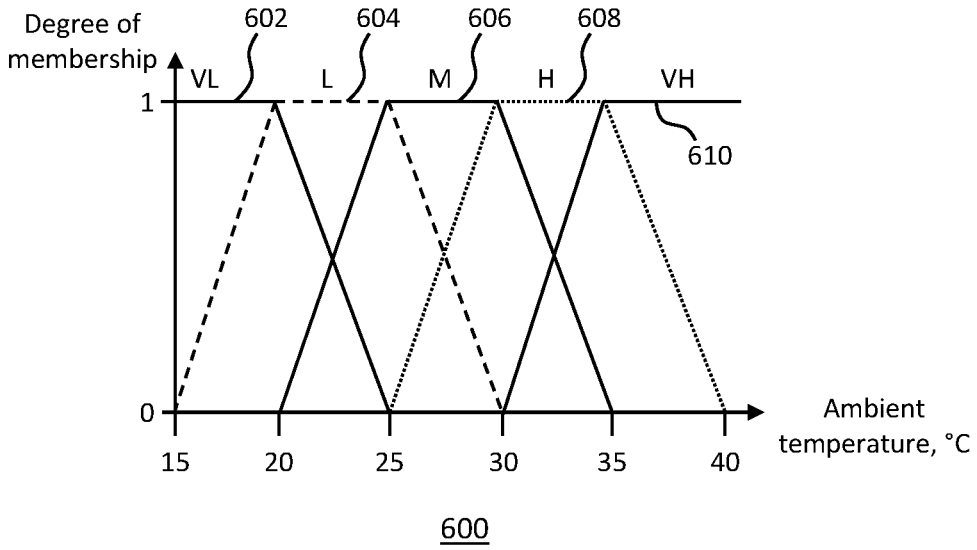
FIG. 6 is a graph showing examples of a set of functions associated with an ambient temperature.

In some examples, the fuzzy logic algorithm also uses an ambient temperature (e.g. a temperature in the environment around or within a printing apparatus) to determine a parameter for curing images on the substrate. That is, for example, calculating the parameter may also be based on the ambient temperature. In some examples, the ambient temperature may be obtained from one or more sensors in or on a printing apparatus. FIG. 6 shows an example of a graph 600 showing examples of a set of functions (e.g. membership functions) associated with the ambient temperature. Some lines are shown as dashed lines for clarity. The graph 600 shows ambient temperature on the X-axis and degree of membership of the functions on the Y-axis. The set of functions includes a very low (VL) ambient temperature function 602, low (L) ambient temperature function 604, medium (M) ambient temperature function 606, high (H) ambient temperature function 608 and very high (VH) ambient temperature function 610. In a particular example, the environment temperature is 25° C. Thus, the VL and H functions 602 and 608 are activated with a value of 0, and the L and M functions 604 and 606 are activated with a value of 1.

In some examples, the output(s) of the activated ambient temperature function(s) such as for example those shown in FIG. 6 may be used along with the substrate temperature constraint to determine a curing capability, e.g. how much heat can be applied to the substrate to cure the images. In some examples, the curing capability may be for example a heating rate, a temperature of heat applied by a heating apparatus, or any other suitable property. FIG. 7 shows a table 700 of activated curing capability functions based on activated substrate temperature constraint and ambient temperature functions. Thus the table 700 shows which curing capability functions are activated from very low (VL), low (L), medium (M), high (H) and very high (VH) curing capability functions based on activated substrate temperature constraint and ambient temperature functions. In FIG. 7, the activated curing capability functions 702 and 704 according to the particular example described above based on a deformation temperature of 60° C., thickness of 5 mm and ambient temperature of 25° C. are shown marked with an asterisk (*). It can be seen that in this examples, the VL, L, M and H curing capability functions are activated.

Figure 8:
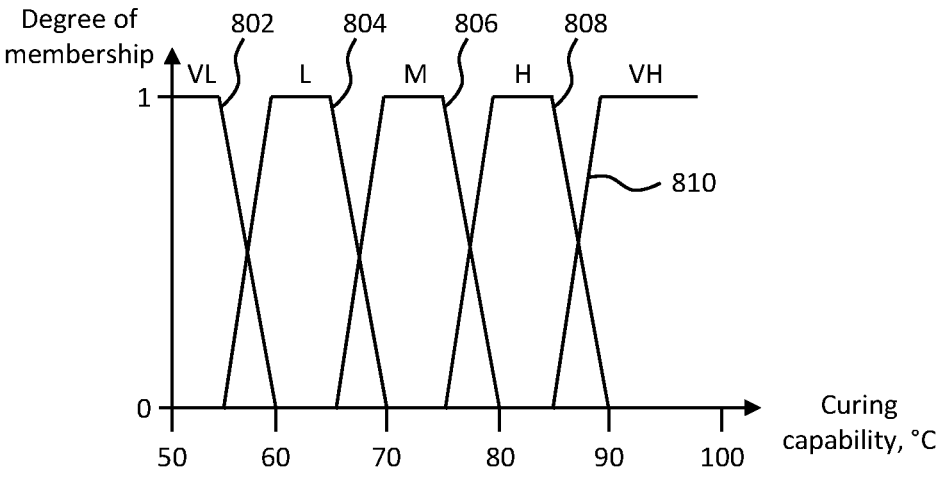
FIG. 8 is a graph showing examples of a set of functions associated with a curing capability.

FIG. 8 shows an example of a graph 800 showing examples of a set of functions (e.g. membership functions) associated with the curing capability. The graph 800 shows curing capability on the X-axis and degree of membership of the functions on the Y-axis. The set of functions includes a very low (VL) curing capability function 802, a low (L) curing capability function 804, a medium (M) curing capability function 806, a high (H) curing capability function 808 and a very high (VH) curing capability function 810. In some examples, the curing capability can be considered as the level of heat that can be applied or cannot be exceeded during a curing process, taking into consideration the ambient temperature and the media temperature constraint. For example, the curing capability can be considered as the temperature output of a heating or curing device. In the particular example described herein, based on a deformation temperature of 60° C., thickness of 5 mm and ambient temperature of 25° C., the VL, L and H curing capability functions 802, 804 and 808 are activated with an output value of 0, and the M function 806 is activated with an output value of 1. Similarly to examples described above, a min t-norm process may be used in some examples to determine the output of curing capability functions 802-810 based on the media temperature constraint and ambient temperature. For example, the values of the antecedent functions (e.g. the functions that activate the activated curing capability functions according to the table 700 of FIG. 7) clip the area of the activated curing capability functions, and the peak values of the areas are the values of the activated curing capability functions.

In some examples, additional properties may be used in the fuzzy logic algorithm to calculate the parameter for curing images on the substrate. These include, for example, the print agent absorbency (e.g. absorbance level) of the substrate and an image quality parameter. The absorbency may be obtained from for example a local or remote database, and in some examples may be obtained based on the identification of the substrate. In other examples, the absorbency may be provided by a user or obtained in any other suitable manner. The image quality parameter may indicate an image quality of images on the substrate or to be applied to the substrate, and may be associated with the images or provided by a user. In some examples, a higher image quality for certain images on the substrate may result in denser print agent on the substrate, and this may for example take longer to cure or dry than lower density print agent.

Figure 9:
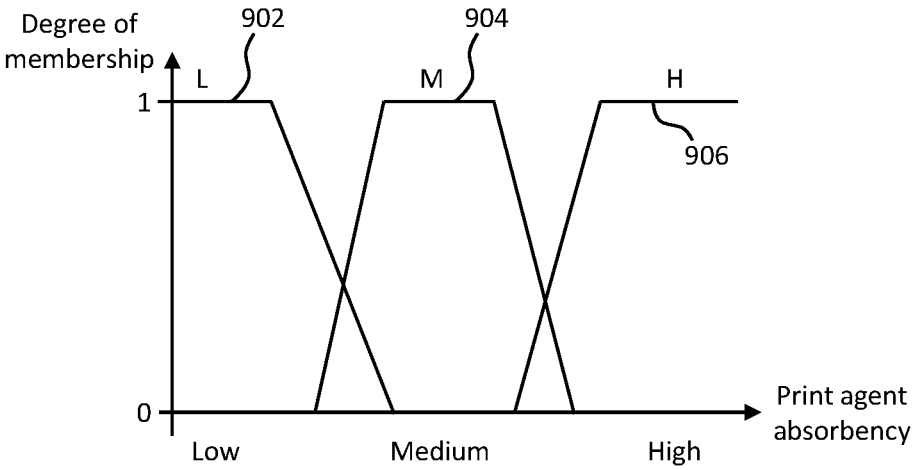
FIG. 9 is a graph showing examples of a set of functions associated with a print agent absorbency.

FIG. 9 shows an example of a graph 900 showing examples of a set of functions (e.g. membership functions) associated with the print agent absorbency. The graph 900 shows absorbency on the X-axis and degree of membership of the functions on the Y-axis. The set of functions includes a low (L) absorbency function 902, a medium (M) absorbency function 904 and a high (H) absorbency function 906. In the particular example described herein, the absorbency of the substrate is high, and activates the high (H) absorbency function with an output value of 1.

Figure 10:
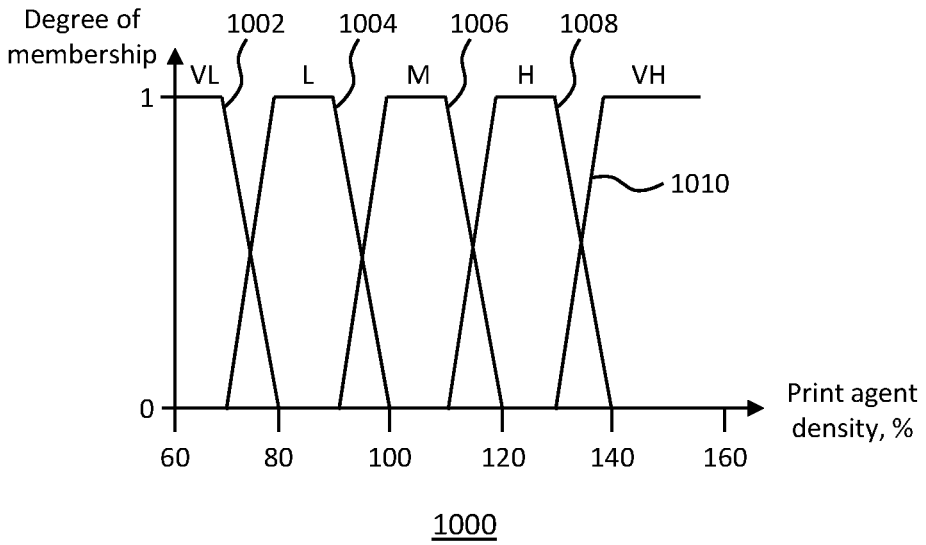
FIG. 10 is a graph showing examples of a set of functions associated with an image quality.

FIG. 10 shows an example of a graph 1000 showing examples of a set of functions (e.g. membership functions) associated with the image quality. In this particular example, the image quality is represented by a print agent density percentage relative to a reference print agent density at 100%. In some examples, the reference print agent density at 100% is the density of print agent applied to a substrate for a "normal" image quality (for example as opposed to a "low" or "draft" image quality, which may apply a lower density of print agent, and a "high" image quality, which may apply a higher density of print agent). The graph 1000 shows print agent density on the X-axis and degree of membership of the functions on the Y-axis. The set of functions includes a very low (VL) print agent density function 1002, a low (L) print agent density function 1004, a medium (M) print agent density function 1006, a high (H) print agent density function 1008 and a very high (VH) print agent density function 1010. In the particular example described herein, the print agent density is 105%, which activates the medium (M) function 1006 at an output level of 1.

In some examples, the output(s) of the activated curing capability function(s) such as for example those shown in FIG. 8 may be used along with the absorbency and print agent density to select a print mode for printing and/or curing the images on the substrate. In some examples, the print mode may be a number of passes (one or more) of a substrate through a printing device during a printing process. In some examples, if the substrate experiences a larger amount of heating and thus curing or drying the print agent on the substrate. In such examples, print agent may be applied to the substrate to form the images in one, some or all of the passes. FIG. 11 shows a table 1100 of activated print mode (e.g. number of passes) functions based on activated curing capability, print agent density and absorbency functions. Thus the table 1100 shows an example of which number of passes functions are activated from very low (VL), low (L), medium (M), high (H) and very high (VH) number of passes functions. In FIG. 11, the activated functions according to the particular example described above are shown marked with an asterisk (*). It can be seen that in this example, the VL, L, M and H curing capability functions are activated.

Figure 12:
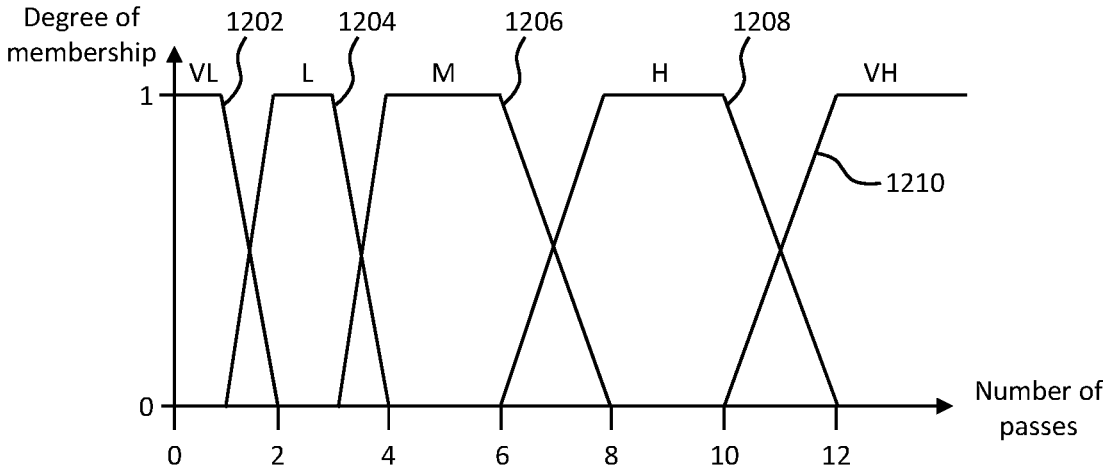
FIG. 12 is a graph showing examples of a set of functions associated with a print mode.

FIG. 12 shows an example of a graph 1200 showing examples of a set of functions (e.g. membership functions) associated with the print mode (e.g. number of passes). The graph 1200 shows absorbency on the X-axis and degree of membership of the functions on the Y-axis. The set of functions includes a very low (VL) number of passes function 1202, a low (L) number of passes function 1204, a medium (M) number of passes function 1206, a high (H) number of passes function 1208 and a very high (VH) number of passes function 1210. In some examples, a min t-norm process may be used along with the values from activated functions associated with curing capability, absorbency and print agent density to clip the activated print mode (e.g. number of passes functions) and provide an area for activated functions of the number of passes. In some examples, a defuzzification process may be used to provide a value for the print mode (e.g. number of passes) based on the area. An example of a defuzzification process is a centroid algorithm. In this defuzzification process, the centre of mass or centroid of the area may be determined and the x-coordinate of this point may be used to determine a print mode (e.g. number of passes) for a printing operation for printing print agent to form images on the substrate. In some embodiments, for example as described above, a parameter for curing images on the substrate may be calculated based on the deformation temperature and a thickness of the substrate using a fuzzy logic algorithm. The fuzzy logic algorithm may for example determine an area of one or more activated functions, and determine the parameter based on a centre of mass or centroid of the area.

In the particular example described above, the L and H functions 1204 and 1208 are activated at 0 level, and the M function 1206 is activated at 1 level. (Effectively, in some examples, this may mean that only the M function 1206 contributes any area as the L and H functions are at 0 level, meaning they have no area.) The centre of mass of this area is above a number of passes of around 5, so for example a print mode with 5 passes may be chosen as the parameter for curing images on the substrate.

In some examples, calculating the parameter using the fuzzy logic algorithm comprises obtaining a first activation level for a first function of the thickness of the substrate, wherein the first activation level indicates a level of membership of the thickness within a first range. The function may be for example one of the functions shown in the graph 300 of FIG. 3. In some examples, more than one thickness function may be activated. Calculating the parameter using the fuzzy logic algorithm may also comprise obtaining a second activation level for a second function of the deformation temperature of the substrate, wherein the second activation level indicates a level of membership of the thickness within a second range. The second function may for example be one of the functions shown in the graph 200 of FIG. 2. In some examples, more than one deformation temperature function may be activated.

Calculating the parameter using the fuzzy logic algorithm may in some examples also comprise selecting a substrate temperature constraint (e.g. upper constraint) function based on the first and second activation levels, and obtaining a third activation level for the substrate temperature constraint function based on the first and second activation levels. The substrate temperature constraint functions may be for example those shown in FIG. 5. In some examples, more than one substrate temperature constraint function may be activated.

In some examples, calculating the parameter using the fuzzy logic algorithm comprises selecting the first function from a first plurality of functions associated with the thickness (e.g. those shown in FIG. 3) based on the thickness, and selecting the second function from a second plurality of functions associated with the deformation temperature (e.g. those shown in FIG. 2) based on the deformation temperature.

In some examples, calculating the parameter using the fuzzy logic algorithm comprises selecting a curing level (e.g. curing capability) function (e.g. from the functions shown in FIG. 8) based on the third activation level and an ambient temperature, and obtaining a fourth activation level for the curing level function based on the third activation level and the ambient temperature.

In some examples, calculating the parameter using the fuzzy logic algorithm comprises selecting a print mode function (e.g. from the functions shown in FIG. 12) based on the fourth activation level, a print agent absorbency of the substrate and an image quality of the images on the substrate. Calculating the parameter using the fuzzy logic algorithm may also comprise obtaining a fifth activation level for the print mode function based on the fourth activation level, a print agent absorbency of the substrate and an image quality of the images on the substrate, and determining the parameter based on the fifth activation level. In some examples, the fifth activation level may be for example the area of the activated print mode function(s), which may be determined in some examples using a t-norm min process, and determining the parameter may comprise determining the parameter from a centre of mass or centroid of the area (e.g. determining the x-coordinate of the area).

In some examples, calculating the parameter using the fuzzy logic algorithm comprises calculating the parameter based further on one or more of an image quality of the images on the substrate, an ambient temperature, a temperature of the substrate and a print agent absorbency of the substrate using the fuzzy logic algorithm. I other examples, one or more other properties or parameters relating to the substrate or any other aspect of a printing process may also be used. In some examples, calculating the parameter using the fuzzy logic algorithm comprises selecting a print mode function rom a plurality of print mode functions (e.g. the functions as shown in FIG. 12) based on the thickness, the deformation temperature, the image quality, the ambient temperature, the temperature of the substrate and the print agent absorbency. The a print mode function activation level of the print mode function may then be determined based on the thickness, the deformation temperature, the image quality, the ambient temperature, the temperature of the substrate and the print agent absorbency. The parameter may then be determined based on the print mode function activation level.

In some examples, causing the printing apparatus to cure the images on the substrate based on the parameter may comprise causing the printing apparatus to control, based on the parameter, one of a speed of the substrate in the printing apparatus, a number of passes of the substrate through the printing apparatus, and an intensity of a heating device in the printing apparatus.

Figure 13:
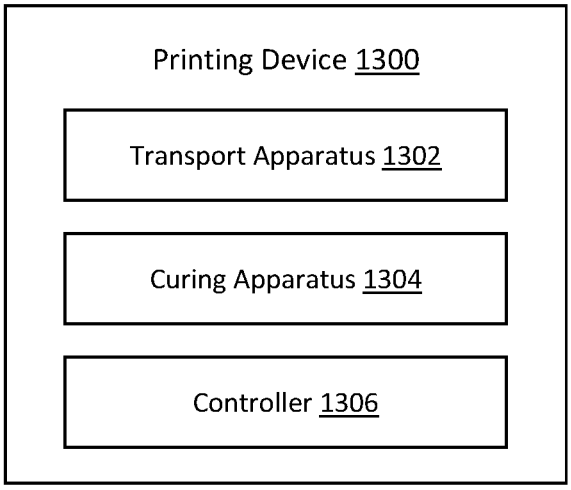
FIG. 13 is a simplified schematic of an example of a printing device.

FIG. 13 is a simplified schematic of an example of a printing device 1300 comprising transport apparatus 1302 to transport media (e.g. through the printing device 1300), curing apparatus 1304 to apply heat to images on the media, and a controller 1306. The controller 1306 is to apply a fuzzy logic process to determine control parameters based on a distortion temperature at which the media distorts and a thickness of the media, and to control one of the transport apparatus and the curing apparatus based on the control parameters. In some examples the printing device (e.g. the controller 1306) may carry out a method such as that described above, and/or the fuzzy logic process may comprise or include a fuzzy logic algorithm as described above.

In some examples, the control parameters comprise parameters to control one of the transport apparatus and the curing apparatus to control a number of passes of the media through the printing device, a speed of the media through the printing device, and a level of heat applied to the media by the curing apparatus. In some examples, the controller is to apply the fuzzy logic process to determine the control parameters based further on one of an image quality of the images on the substrate, an ambient temperature, a temperature of the substrate and a print agent absorbency of the substrate using the fuzzy logic algorithm.

Figure 14:
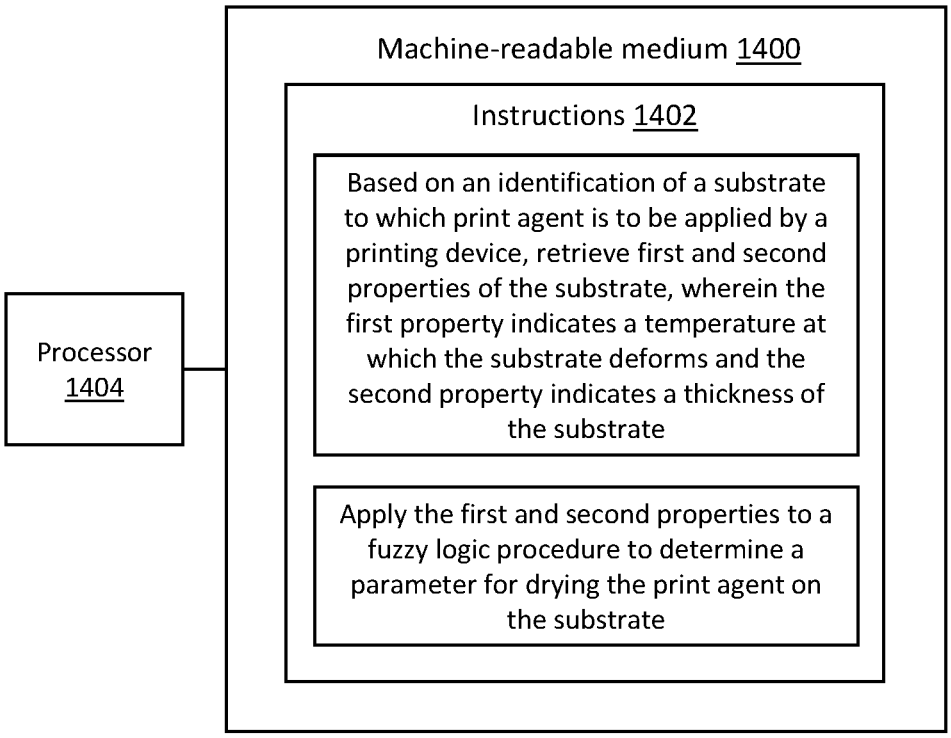
FIG. 14 is a simplified schematic of an example of a machine-readable medium.

FIG. 14 is a simplified schematic of an example of a machine-readable medium 1400 comprising instructions 1402 that, when executed by a processor 1404, cause the processor 1404 to, based on an identification of a substrate to which print agent is to be applied by a printing device, retrieve first and second properties of the substrate, wherein the first property indicates a temperature at which the substrate deforms and the second property indicates a thickness of the substrate. The instructions 1402 also comprise instructions 1402 that, when executed by a processor 1404, cause the processor 1404 to apply the first and second properties to a fuzzy logic procedure to determine a parameter for drying the print agent on the substrate. In some examples, the fuzzy logic procedure may comprise or include a fuzzy logic algorithm such as for example as described above.

In some examples, the instructions 1402 also comprise instructions 1402 that, when executed by a processor 1404, cause the processor 1404 to apply the first and second properties to the fuzzy logic procedure to determine the parameter for drying the print agent on the substrate by determining a first value indicating a degree of membership of a first set for the first property, determining a second value indicating a degree of membership of a second set for the second property, selecting a function based on the first and second values, and determining a third value using the function based on the first and second values, wherein the third value indicates a media temperature constraint for drying the print agent on the substrate. Each set may comprise for example a range for a function, such as for example a function as described herein.

In some examples, the instructions 1402 also comprise instructions 1402 that, when executed by a processor 1404, cause the processor 1404 to apply the first and second properties to the fuzzy logic procedure to determine the parameter for drying the print agent on the substrate by determining a fourth value indicating a degree of membership of a third set for the first property, selecting a further function based on the second and fourth values, and determining a fifth value using the further function based on the second and fourth values, wherein the fifth value indicates a further media temperature constraint for drying the print agent on the substrate.

In some examples, the instructions 1402 also comprise instructions 1402 that, when executed by a processor 1404, cause the processor 1404 to apply the first and second properties to the fuzzy logic procedure to determine the parameter for drying the print agent on the substrate by selecting an additional function based on the third value and an ambient temperature, and determining a heating rate limit using the additional function based on the third value and the ambient temperature.

Ranges can be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed that "less than or equal to" the value, "greater than or equal to the value" and possible ranges between values are also disclosed, as appropriately understood by the skilled artisan. For example, if the value "10" is disclosed the "less than or equal to 10" as well as "greater than or equal to 10" is also disclosed. It is also understood that throughout the application, data is provided in a number of different formats and that this data represents endpoints and starting points, and ranges for any combination of the data points. For example, if a particular data point "10" and a particular data point 15 are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method of curing images on a substrate, the method comprising:

identifying the substrate;

determining a deformation temperature of the substrate based on the identifying;

calculating a parameter for curing images on the substrate based on the deformation temperature and a thickness of the substrate using a fuzzy logic algorithm; and causing a printing apparatus to cure the images on the substrate based on the parameter.

2. The method of claim 1, wherein calculating the parameter using the fuzzy logic algorithm comprises:

obtaining a first activation level for a first function of the thickness of the substrate, wherein the first activation level indicates a level of membership of the thickness within a first range;

obtaining a second activation level for a second function of the deformation temperature of the substrate, wherein the second activation level indicates a level of membership of the thickness within a second range;

selecting a substrate temperature upper constraint function based on the first and second activation levels; and obtaining a third activation level for the substrate temperature upper constraint function based on the first and second activation levels.

3. The method of claim 2, wherein calculating the parameter using the fuzzy logic algorithm comprises:

selecting the first function from a first plurality of functions associated with the thickness based on the thickness; and selecting the second function from a second plurality of functions associated with the deformation temperature based on the deformation temperature.

4. The method of claim 2, wherein calculating the parameter using the fuzzy logic algorithm comprises:

selecting a curing level function based on the third activation level and an ambient temperature;

obtaining a fourth activation level for the curing level function based on the third activation level and the ambient temperature.

5. The method of claim 4, wherein calculating the parameter using the fuzzy logic algorithm comprises:

selecting a print mode function based on the fourth activation level, a print agent absorbency of the substrate and an image quality of the images on the substrate;

obtaining a fifth activation level for the print mode function based on the fourth activation level, a print agent absorbency of the substrate and an image quality of the images on the substrate; and determining the parameter based on the fifth activation level.

6. The method of claim 1, wherein calculating the parameter using the fuzzy logic algorithm comprises calculating the parameter based further on one of an image quality of the images on the substrate, an ambient temperature, a temperature of the substrate and a print agent absorbency of the substrate using the fuzzy logic algorithm.

7. The method of claim 6, wherein calculating the parameter using the fuzzy logic algorithm comprises:

selecting a print mode function from a plurality of print mode functions based on the thickness, the deformation temperature, the image quality, the ambient temperature, the temperature of the substrate and the print agent absorbency;

determining a print mode function activation level of the print mode function based on the thickness, the deformation temperature, the image quality, the ambient temperature, the temperature of the substrate and the print agent absorbency; and determining the parameter based on the print mode function activation level.

8. The method of claim 1, wherein causing the printing apparatus to cure the images on the substrate based on the parameter comprises causing the printing apparatus to control, based on the parameter, one of a speed of the substrate in the printing apparatus, a number of passes of the substrate through the printing apparatus, and an intensity of a heating device in the printing apparatus.

9. A printing device comprising:

transport apparatus to transport media;

curing apparatus to apply heat to images on the media; and a controller to apply a fuzzy logic process to determine control parameters based on a distortion temperature at which the media distorts and a thickness of the media, and to control one of the transport apparatus and the curing apparatus based on the control parameters.

10. The printing device of claim 9, wherein the control parameters comprise parameters to control one of the transport apparatus and the curing apparatus to control a number of passes of the media through the printing device, a speed of the media through the printing device, and a level of heat applied to the media by the curing apparatus.

11. The printing device of claim 9, wherein the controller is to apply the fuzzy logic process to determine the control parameters based further on one of an image quality of the images on the substrate, an ambient temperature, a temperature of the substrate and a print agent absorbency of the substrate using the fuzzy logic algorithm.

12. A machine-readable medium comprising instructions that, when executed by a processor, cause the processor to:

based on an identification of a substrate to which print agent is to be applied by a printing device, retrieve first and second properties of the substrate, wherein the first property indicates a temperature at which the substrate deforms and the second property indicates a thickness of the substrate; and apply the first and second properties to a fuzzy logic procedure to determine a parameter for drying the print agent on the substrate.

13. The machine-readable medium of claim 12 comprising instructions that, when executed by a processor, cause the processor to apply the first and second properties to the fuzzy logic procedure to determine the parameter for drying the print agent on the substrate by:

determining a first value indicating a degree of membership of a first set for the first property;

determining a second value indicating a degree of membership of a second set for the second property;

selecting a function based on the first and second values; and determining a third value using the function based on the first and second values, wherein the third value indicates a media temperature constraint for drying the print agent on the substrate.

14. The machine-readable medium of claim 13 comprising instructions that, when executed by a processor, cause the processor to apply the first and second properties to the fuzzy logic procedure to determine the parameter for drying the print agent on the substrate by:

determining a fourth value indicating a degree of membership of a third set for the first property;

selecting a further function based on the second and fourth values; and determining a fifth value using the further function based on the second and fourth values, wherein the fifth value indicates a further media temperature constraint for drying the print agent on the substrate.

15. The machine-readable medium of claim 13 comprising instructions that, when executed by a processor, cause the processor to apply the first and second properties to the fuzzy logic procedure to determine the parameter for drying the print agent on the substrate by:

selecting an additional function based on the third value and an ambient temperature; and determining a heating rate limit using the additional function based on the third value and the ambient temperature.

* * * * *